US005953696A

United States Patent [19]

Nishiguchi et al.

[11] Patent Number: 5,953,696

[45] **Date of Patent: *Sep. 14, 1999**

[54] DETECTING TRANSIENTS TO EMPHASIZE FORMANT PEAKS

[75] Inventors: Masayuki Nishiguchi; Jun Matsumoto, both of Kanagawa, Japan

[73] Assignee: Sony Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/935,695

[22] Filed: Sep. 23, 1997

Related U.S. Application Data

[63] Continuation of application No. 08/398,363, Mar. 3, 1995, abandoned.

[30] Foreign Application Priority Data

Mar. 10, 1994 [JP] Japan ..... 6-039979

[51] Int. Cl.[6] ..... G10L 9/02

[52] U.S. Cl. ..... 704/209; 704/224

[58] Field of Search ..... 704/207–209, 704/224–226

[56] References Cited

U.S. PATENT DOCUMENTS

| | | | |
|---|---|---|---|
| 4,566,117 | 1/1986 | Suckle | 381/51 |
| 4,586,193 | 4/1986 | Seiler et al. | 381/51 |
| 4,813,076 | 3/1989 | Miller | 381/43 |
| 4,980,917 | 12/1990 | Hutchins | 381/41 |
| 5,235,669 | 8/1993 | Ordentlich et al. | 395/2 |
| 5,459,813 | 10/1995 | Klayman | 395/2.18 |
| 5,479,560 | 12/1995 | Mekata | 395/2.18 |
| 5,536,902 | 7/1996 | Serra et al. | 84/623 |

*Primary Examiner*—David D. Knepper
*Attorney, Agent, or Firm*—Limbach & Limbach LLP

[57] ABSTRACT

Nasalized sound effects during reproduction of low-pitch sounds are suppressed to produce playback sounds of high clarity. Amplitude data is processed with high range formant emphasis of crests and valleys of the envelope of the frequency spectrum on the high frequency range and with deepening of the valley of the frequency spectrum over the entire frequency range, above all, over the low to mid frequency range. Next, the amplitude data is processed for emphasizing the peak values of the formant of the voiced frame in the portion of the speech signal which is rising in magnitude and for unconditionally emphasizing the spectral envelope on the high frequency range. The voiced speech spectrum is generated by synthesizing the cosine wave based upon the emphasized amplitude data.

7 Claims, 10 Drawing Sheets

DETECTING TRANSIENTS TO EMPHASIZE FORMANT PEAKS

This is a continuation of application Ser. No. 08/398,363 filed on Mar. 3, 1995, now abandoned.

BACKGROUND OF THE INVENTION

This invention relates to a speech signal processing method employed for a speech synthesis system. More particularly, it relates to a speech signal processing method advantageously employed for a post-filter of a speech synthesis system of a multiband excitation (MBE) speech decoder.

There are known a variety of encoding methods for signal compression utilizing statistic characteristics of speech signals in the time domain and in the frequency domain and human psychoacoustic characteristics. These speech encoding methods may be roughly divided into encoding in the time domain, encoding in the frequency domain and synthesis analysis encoding.

As practical example of speech signal encoding, there are known the multiband excitation (MBE) coding, single band excitation (SBE) coding, harmonic coding, sub-band coding, linear predictive coding (LPC), discrete cosine transform (DCT), modified DCT (MDCT) and fast Fourier transform (FFT).

In the speech signal analysis synthesis system, centered about processing in the frequency domain, such as the above-mentioned MBE coding system, it is a frequent occurrence that spectral distortion is produced due to quantization error and signal deterioration becomes acute in a high frequency range having a small number of allocated bits. The result is loss of clarity and nasalized speech due to power loss or disappearance of the high-range formant or power loss in the entire high frequency range. This is particularly the case with the speech of a male speaker having a low pitch and high content of harmonics, in which, if zero-phase addition is made during cosine synthesis, acute peaks are generated at the pitch periods, thus producing nasalized speech.

For compensating such inconvenience, a formant emphasis filter, such as an infinite impulse response filter (IIR), employed for making the compensation in the time domain, is employed. In such case, however, filter coefficients for formant emphasis need be calculated for each speech processing frame, thus rendering real time processing difficult. In addition, it is necessary to take account of filter stability, such that it is not possible to derive the effect proportionate to the quantity of the arithmetic-logic operations.

If suppression of the spectral valleys in the low frequency range is performed perpetually, a modulated noise sound like "shuru-shuru" is produced in the unvoiced (UV) domain. On the other hand, if formant emphasis is perpetually performed, there is produced spectral distortion by side effects which will give an impression as if two speakers were talking simultaneously.

SUMMARY OF THE INVENTION

In view of the foregoing, it is an object of the present invention to provide a speech signal processing method whereby the processing such as formant emphasis in the speech synthesis system is simplified to permit facilitated real-time processing.

It is another object of the present invention to provide a signal processing method whereby the high clarity playback speech sound may be derived by the post-filter effect while suppressing noise generation due to valley suppression and the side effect of producing speech distortion which will give an impression as if two speakers were talking simultaneously.

In its one aspect, the present invention provides a speech signal processing method employed in a speech synthesis system centered about processing in the frequency domain, including performing the processing of deepening valley portions between formants of the transmitted frequency spectrum on the basis of comparison of a signal representing the intensity of the spectrum with a version of such signal obtained on smoothing on the frequency axis.

The smoothing may be carried out by taking a moving average of the information indicating the intensity of the frequency spectrum on the frequency axis. The processing of deepening the valley portions between the formants of the frequency spectrum may be performed on the basis of a difference between the signal representing the intensity of the spectrum and the version of the signal obtained on smoothing on the frequency axis. The amount of attenuation of deepening of the valley portions between the formants of the frequency spectrum is varied depending on the magnitude of such difference.

The signal indicating the intensity of the transmitted frequency spectrum may be discriminated as to whether the signal indicating the intensity of the transmitted frequency spectrum is of a voiced domain or an unvoiced domain and the above processing may be carried out only for the voiced domain.

In another aspect, the present invention provides a speech signal processing method employed in a speech synthesis system centered about processing in the frequency domain including emphasizing formants of the frequency spectrum in the rising portion of speech signals by directly acting on frequency domain parameters.

The formant emphasis processing may be performed only for the voiced speech domain. The above processing may also be performed only on the low frequency side of the frequency spectrum. Preferably, the level increasing operation is carried out only on a peak point of the frequency spectrum.

The above emphasis processing operations are performed by directly acting on frequency domain parameters. The speech signal processing method having such characteristics may preferably be employed as a post-filter of the speech synthesis route of a speech decoding device of the MBE system.

With the above-described speech signal processing method of the present invention, since the emphasis processing is carried out by directly acting on the frequency domain parameters, only the signal portion desired to be emphasized may be correctly emphasized by a simplified arrangement and a simplified operation for improving the clarity of the synthesized sound without impairing the feeling of the natural speech. This can be achieved easily by the real-time processing since it becomes unnecessary to carry out the calculations for finding the filter pole position thought to be indispensable for real-time processing employing the high range enhancement filter along the time axis, such as an IIR filter. In this manner, it becomes possible to avoid ill effects due to filter instability.

Since the processing of deepening the valley portions between the formants of the frequency spectrum is performed on the basis of a signal representing the intensity of the spectrum and a version of the signal obtained on smoothing on the frequency axis, it becomes possible to reduce the nasalized speech effect of the reproduced speech.

By performing the processing of deepening the valley portions between the formants of the frequency spectrum on the basis of a difference between the signal representing the intensity of the spectrum and the version of such signal obtained on smoothing on the frequency axis, effective emphasis may be achieved by simplified calculating operations. By performing emphasis processing only for the voiced speech domain, it becomes possible to suppress the "shuru-shuru" modulated noise sound ascribable to emphasis of the unvoiced sound.

In a speech signal processing method employed in a speech synthesis system centered about processing in the frequency domain, by performing the processing of deepening valley portions between formants of the transmitted frequency spectrum at the rising portion of the speech signal by directly acting on frequency domain parameters, the 'modulated' playback speech sound with better clarity may be produced, while the spectral distortion by side effects which will give an impression as if two speakers were talking simultaneously may be diminished.

By performing the emphasis processing only on the voiced domain, the side effect caused by emphasis of the unvoiced sound may be diminished. On the other hand, by increasing the level only on peak points of the frequency spectrum, the formant shape may become thinner with the result that the reproduced sound becomes clearer without impairing the effect of lowering the formant valley portions by the remaining emphasis processing operations.

DETAILED DESCRIPTION OF THE INVENTION

Figure 1:
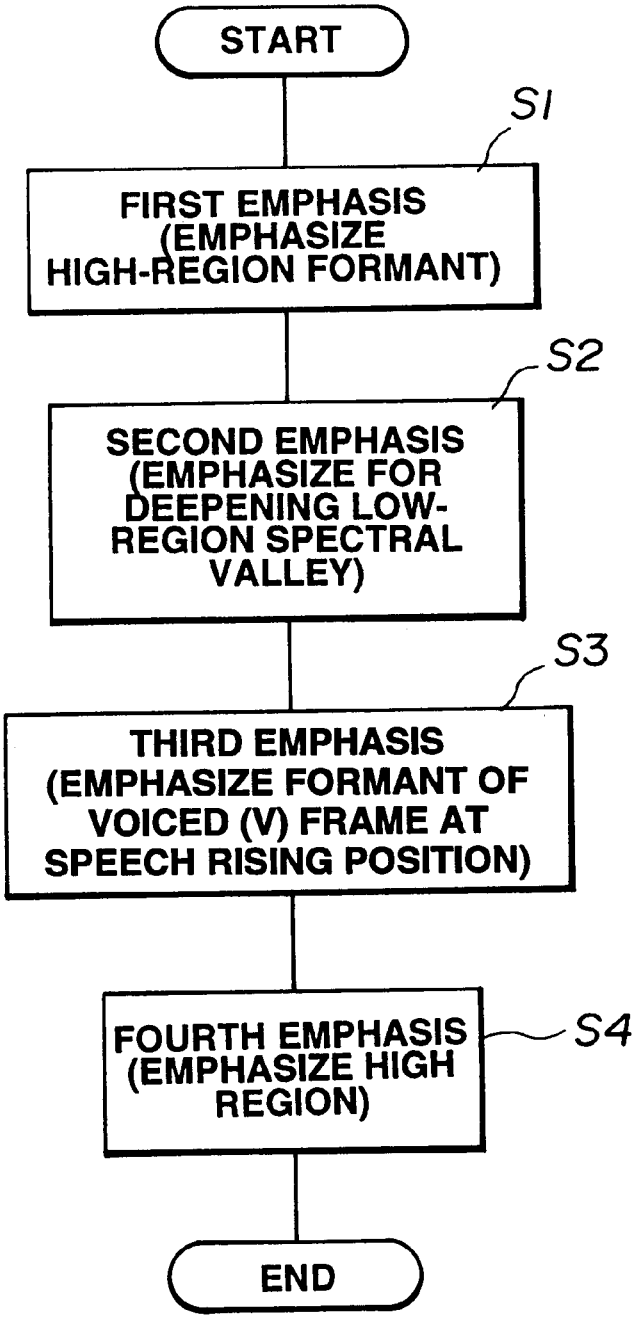
FIG. 1 is a flow chart showing the basic operation of a speech signal processing method according to the present invention.

FIG. 1 illustrates, in a flow chart, the schematic operation of a critical portion of the speech signal processing method embodying the present invention. It is presupposed that the speech signal processing method of the present embodiment is employed for a speech synthesis system the processing of which is mainly the frequency-domain processing, more specifically, the processing of the transmitted frequency-domain information converted on the encoding side from the speech signal on the time axis to that on the frequency axis. Specifically, the speech signal processing method of the present embodiment is employed for a post-filter of a speech synthesis route in a speech decoding device of the multi-band excitation MBE) system. In the speech signal processing method of the present embodiment, shown in FIG. 1, signal processing is executed by directly acting on the frequency-domain data of the speech spectrum.

Referring to FIG. 1, high-range formant emphasis is carried out in step S1 for emphasizing crest and valley portions of an envelope of the high-range side frequency spectrum by way of performing a first emphasis operation. At the next step S2, the valley portions of the envelope of the frequency spectrum are deepened for the entire frequency range, above all, for the mid to low frequency range, by way of performing a second emphasis operation. At the next step S3, the processing of emphasis is performed for emphasizing the peak value of the formant of the voiced sound (V) frame at the rising speech signal portion by way of performing the third emphasis operation. At the next step S4, the processing of high-range emphasis is performed for unconditionally emphasizing the envelope of the high-range frequency spectrum, by way of performing fourth emphasis operation.

At these steps S1 to S4, the first to fourth emphasis operations are executed by directly acting on the band-to-band amplitude values, as parameters on the frequency domain, or the spectral intensity of harmonics repeated at a pitch interval on the frequency axis. One or more of the first to fourth emphasis operations of the steps S1 to S4 may be optionally omitted, or the sequence of carrying out the emphasis operations may be exchanged in a desired manner.

Before proceeding to a detailed description of the emphasis operations of the steps S1 to S4, the schematic arrangement of a speech decoding device of the multiband excitation (MBE) system, as a speech synthesis system, will be explained by referring to FIG. 2.

Figure 2:
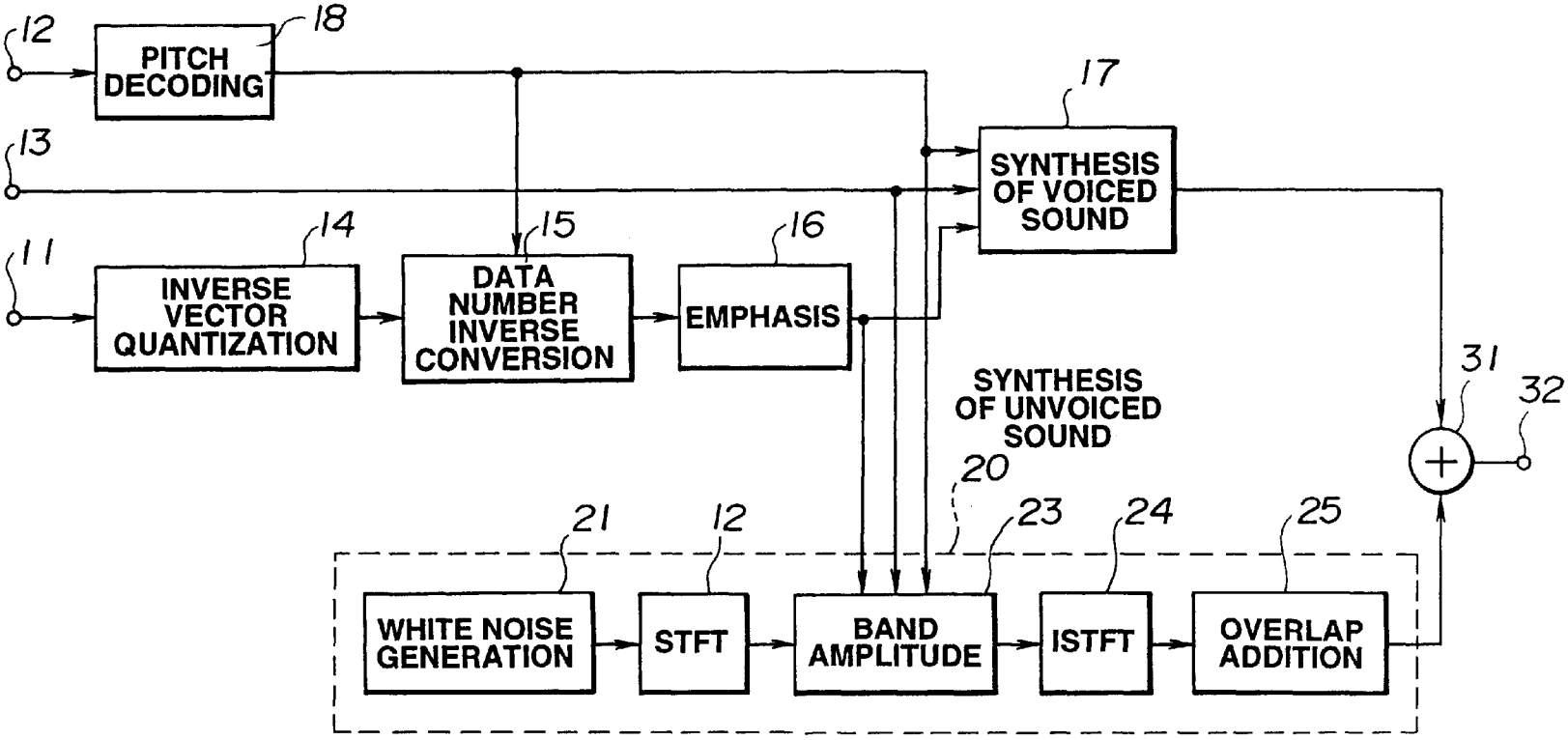
FIG. 2 is a functional block diagram showing a schematic arrangement of a speech decoding device on the synthesis or decoding side of a speech synthesis analysis encoding device as a practical example of a device adapted for carrying out the speech signal processing method shown in FIG. 1.

To an input terminal 11 of FIG. 2 is supplied quantized amplitude data transmitted from a speech encoding device of the MBE system, as later explained, or a so-called MBE vocoder. The quantized amplitude data is the data produced by the MBE vocoder by converting the amplitude values of respective bands, divided on the basis of the pitch of the speech signals as a unit from the spectrum for each time frame of input speech signals, into a constant number of data not dependent on the pitch value from band to band, and by vector quantizing the resulting data number data. To input terminals 12 and 13 are supplied pitch data encoded by the MBE vocoder and voiced/unvoiced (V/UV) discrimination data for discriminating, for each band, whether the sound in the bands is voiced or unvoiced.

The quantized amplitude data from the input terminal 11 are fed to an inverse vector quantization unit 14 for inverse quantization. The quantized amplitude data are fed to an inverse data number converting unit 15 for inverse conversion into the band-to-band amplitude values (amplitude data) which are then routed to an emphasis processing unit 16 which is the crucial portion of the present embodiment of the invention. In the emphasis processing unit 16, the first to fourth emphasis operations, corresponding to the steps S1 to S4 of FIG. 1, are performed on the amplitude data. That is, the emphasis processing unit 16 performs the first emphasis operation of emphasizing the crests and the valleys of the high range side, as the high-range formant emphasis operation, the second emphasis operation of deepening the valleys in the entire range, above all, the mid-to-low range, the third emphasis operation of emphasizing the peak value of the formant of the voiced frame at the signal rising portion and the fourth emphasis operation of unconditionally emphasizing the high range side spectrum.

The amplitude data, obtained on performing the emphasis processing at the emphasis processing unit 16, is transmitted to a voiced sound synthesis unit 17 and an unvoiced sound synthesis unit 20.

The encoded pitch data from the input terminal 12 is decoded by a pitch decoding unit 18, from which it is transmitted to the inverse data number converting unit 15, voiced sound synthesis unit 17 and the unvoiced sound synthesis unit 20. The voiced/unvoiced discrimination data from the input terminal 13 is routed to the voiced sound synthesis unit 17 and the unvoiced sound synthesis unit 20. The voiced sound synthesis unit 17 synthesizes the voiced sound waveform on the time axis by, for example, cosine wave synthesis, and transmits the resulting signal to an additive node 31.

The unvoiced sound synthesis unit 20 multiplies the white noise on the time axis from a white noise generator 21 with a suitable window function, such as Hamming function, at a pre-set length of, for example, 256 samples, and processes the windowed waveform with short-term Fourier transform (STFT) by an STFT processing unit 22, in order to produce a frequency-domain power spectrum of the white noise signal. The power spectrum from the STFT processing unit 22 is transmitted to a band amplitude processing unit 23 where the bands found to be unvoiced (UV) are multiplied by the above amplitude and the remaining bands found to be voiced (V) are reduced to a zero amplitude. The band amplitude processing unit 23 is also fed with the amplitude data, pitch data and the V/UV discrimination data. An output of the band amplitude processing unit 23 is transmitted to an ISTFT processing unit 24 where it is inverse STFTed into the original time-domain signal, using the phase of the original white noise as the phase. An output of the ISTFT processing unit 24 is transmitted to an overlap addition unit 25 where overlap and addition are repeatedly performed with suitable weighting on the time axis so that the original continuous noise waveform will be restored. In this manner, a continuous time-axis waveform will be synthesized. An output signal from the overlap addition unit 25 is transmitted to the additive node 31.

The voiced and unvoiced signals, restored into signals on the time axis by synthesis at the synthesis units 17, 20, are summed at the additive node 31 at a suitable fixed mixing ratio for taking out a reproduced speech signal at an output terminal 32.

The emphasis operations at the emphasis processing unit 16, that is the respective processing operations at the steps S1 to S4 shown in FIG. 1, will be explained in detail by referring to the drawings.

Figure 3:
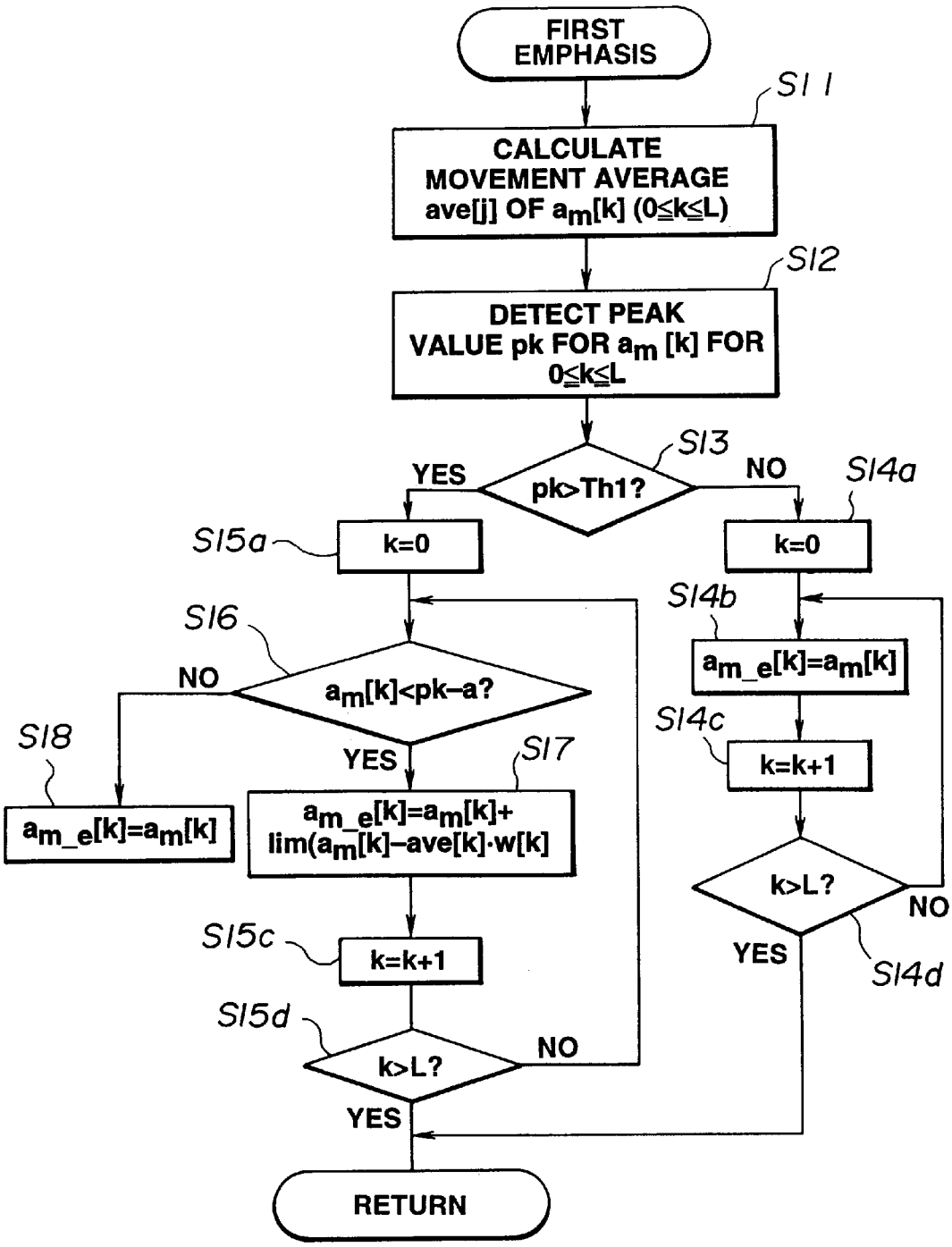
FIG. 3 is a flow chart showing the operation of the first emphasis operation of the processing method.

The flow chart of FIG. 3 shows a practical example of emphasizing the crests and valleys at the high range side of the spectrum at step S1 of FIG. 1.

The spectral envelope information from the inverse data number conversion unit 15 is assumed to be $a_m[k]$. This $a_m[k]$ stands for the value of intensity or amplitude of spectral components at an interval of the pitch angular frequency $\omega_0$ corresponding to the pitch period, that is harmonics. There are P/2 such amplitude values up to (fs/2). On the other hand, k stands for an index number of the number of harmonics or the band, which is an integer incremented at the pitch period on the frequency axis, fs stands for the sampling frequency and P stands for the pitch lag, that is a value representing the number of samples corresponding to the pitch period. It is noted that $a_m[k]$ is data in the dB region prior to restoration to the linear value.

At step S11 in FIG. 3, a smoothed version of $a_m[k]$ is calculated by taking a moving average for producing an approximate shape of the spectrum. This moving average is represented by the following equations:

$$ave[j] = \frac{1}{w}\sum_{k=j-\frac{w-1}{2}}^{j+\frac{w-1}{2}} a_m[k] \quad (1)$$

$$\text{if } \frac{w-1}{2} \le j \le L - \frac{w-1}{2},\ w = 7,\ 0 \le k \le L$$

$$ave[j] = \frac{1}{j + \frac{w-1}{2} + 1}\sum_{k=0}^{j+\frac{w-1}{2}} a_m[k] \quad (2)$$

$$\text{if } 0 \le j < \frac{w-1}{2},\ w = 7$$

$$ave[j] = \frac{1}{L - j + \frac{w-1}{2} + 1}\sum_{k=j-\frac{w-1}{2}}^{L} a_m[k] \quad (3)$$

$$\text{if } L - \frac{w-1}{2} < j \le L,\ w = 7$$

In the above equations, L+1 stands for the number of effective harmonics. Usually, L=P/2 and, if the bandwidth is limited at, for example, 3400 Hz, L=(P/2)×(3400/4000).

The above equation (1) represents a case in which terminal points of data employed for calculating the moving average are within a range of not less than 0 and not more than L. The above equations (2) and (3) represent cases in which zero-side and the L-side of the above range coincide with the data terminal points, that is in which there are not available w data for calculations. In these cases, only the available data are utilized for finding the moving average. For example, the 0'th moving average data ave[0] and the first moving average data aver[1] are found by carrying out the following calculation in accordance with the equation (2):

$$ave[0] = \frac{1}{4}\sum_{k=0}^{3} a_m[k]$$

$$ave[1] = \frac{1}{5}\sum_{k=0}^{4} a_m[k]$$

At the next step S12, the maximum value among the band-based amplitude values is found. That is, a peak value in a domain of $0 \leqq k < L$ of $a_m[k]$ is detected. For example, L is equal to 25, its peak value being denoted as pk.

At the next step S13, it is determined whether or not the maximum value or the peak value pk is larger than a pre-set threshold value $Th_1$. If the result is NO, the operations of the steps S14*a* to S14*d* are executed, without executing the high-range formant emphasis operations. The program then is terminated or returned. If, at step S13, the peak value pk is found to be larger than a pre-set threshold value $Th_1$, the program shifts to step S15*a* to execute the high-range formant emphasis operation as later explained. Specifically, the following enhancement operation is executed only when the peak value pk is larger than the threshold value $Th_1$, in consideration that emphasis produces only unnatural feeling if the spectral values, that is the band-based amplitude values, are small. For example, the threshold value $Th_1$ is set to 65.

For the present formant emphasis operation, it is detected at step S16 whether or not $a_m[k]$ is smaller than $pk-\alpha$ for k in a range of $0 \leqq k < L$. If the result is YES, the program shifts to step S17 and, if otherwise, the program shifts to step S18. For example, $\alpha$ is set to 23.

At step S17, if the amplitude value of the output spectral envelope is $a_m[k]$, the formant emphasis represented by the equation $$a_{m_e}[k]=a_m[k]+\lim(a_m[k]-\mathrm{ave}[k])\cdot w[k] \tag{4}$$

Figure 4:
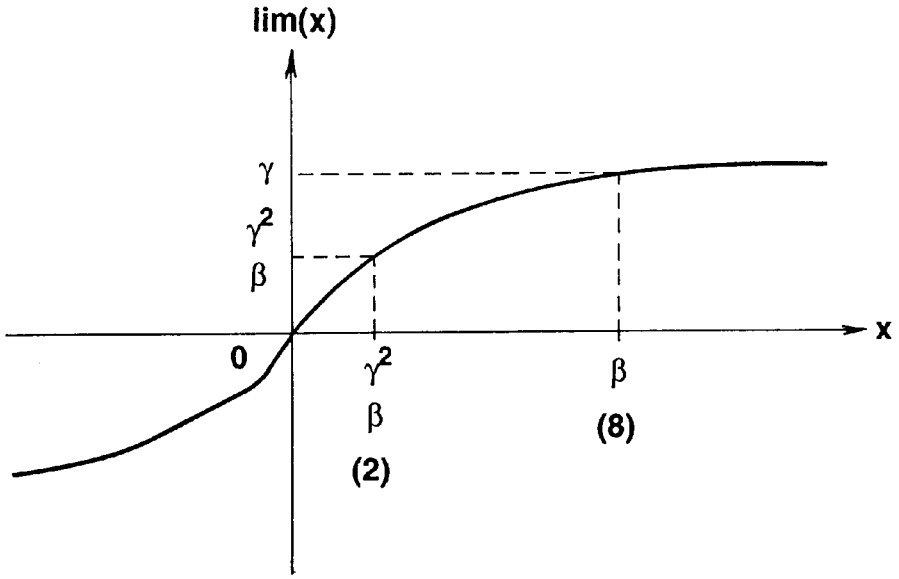
FIG. 4 is a chart showing a function for the manner of emphasis for the first emphasis operation.

In the above equation, w[k] is a weighting function of affording frequency characteristics to the emphasis operation. The weighting is made in such a manner that weighting of from 0 to 1 is made progressively from the low range side towards the high range side. This renders the formant emphasis more effective in the high frequency side. If the input is x, the functions $$\lim(x)=\mathrm{sgn}(x)(|x|)/\beta)^{1/2};\ \text{for } |x| \leqq \beta$$

$$\lim(x)=\mathrm{sgn}(x)\cdot\gamma \text{ for } |x|>\beta \tag{5}$$

may be employed for the function lim( ) in the equation (4). In the above equation, sgn(x) is a function which returns the sign of x, such that sgn(x)=1 for $x \geqq 0$ and sgn(x)=−1 when $x<0$. An example of the function lim(x) is shown in FIG. 4, in which the figure in the bracket is a value for $\beta=8$ and $\gamma=4$.

At the step S18, to which the program shifts for $a_m[k] \geqq pk-60$, the input data is directly outputted, such that $$a_{m_e}[k]=a_m[k] \tag{6}$$

The steps S15*a*, S15*c* and S15*d* represent the processing operations for carrying out the calculations while incrementing k by 1 from 0 up to L.

The output $a_{m_e}[k]$, produced by the above processing operations, is emphasized at the crest and valley portions on the high range side.

It is noted that, at the steps S14*a* to S14*d*, the operation of replacing the output value $a_{m_e}[k]$ directly by $a_m[k]$ as represented by the equation (6) is carried out for all values of k in the range of $0 \leqq k < L$ in order to produce an output not processed with the above-described high range side formant emphasis.

Figure 5:
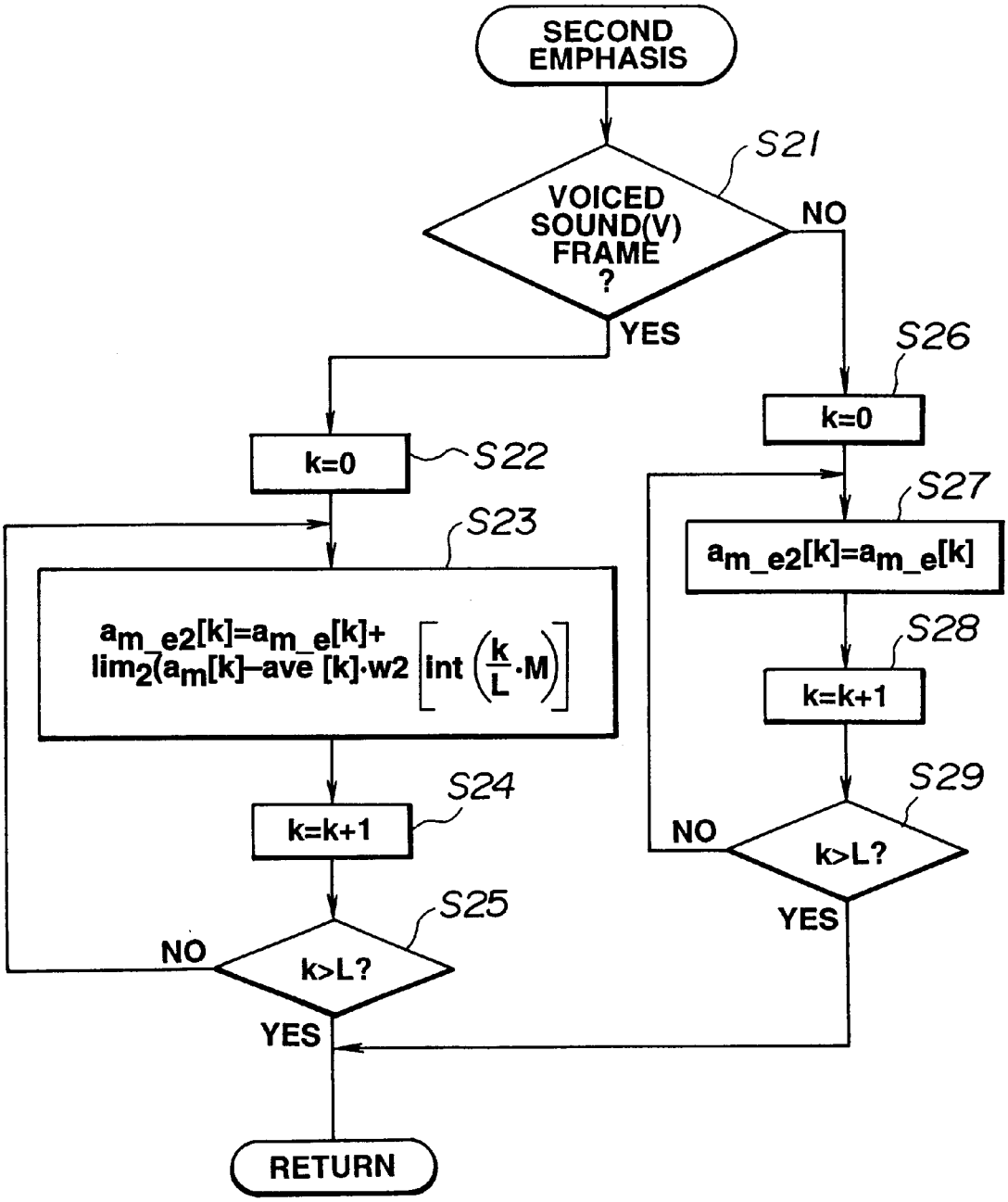
FIG. 5 is a flow chart showing the operation of the second emphasis operation of the processing method.

The flow chart of FIG. 5 shows a practical example of the processing operations for deepening the valley of the spectrum of the entire range as the second enhancement processing operations of the step S2 of FIG. 1.

At the first step S21 of FIG. 5, it is judged whether or not the frame currently processed is the voiced (V) frame or the unvoiced (UV) frame. If the MBE vocoder exploiting the multi-band excitation encoding as later explained is employed on the encoder side, the band-based V/UV discrimination data may be employed for executing the V/UV discrimination. If, of the band-based discrimination flags, the number of V flags and that of UV flags are equal to $N_V$ and $N_{UV}$, respectively, it suffices to find the V discrimination flag content ratio $N_V/(N_V+N_{UV})$ for the entire range, such as the range of 200 to 3400 kHz, and to judge a given frame to be a voiced (V) frame if the ratio exceeds a pre-set threshold value, such as 0.6. If the number of the V/UV discrimination bands is selected or decreased to about 12, the value of $(N_V+N_{UV})$ is on the order of 12. If the V/UV changeover point is represented by a sole point, such as for setting the low range side and the high range side to V and UV, respectively, a given frame may be judged to be a voiced (V) frame if the changeover position is on a higher range side with respect to about 2040 Hz which is a point about 60% of the effective range of 200 to 3400 Hz.

If the current frame is found at step S21 to be a voiced (V) frame, the program shifts to steps S22 to S25 in order to execute the emphasis processing as later explained. Of these steps, the steps S22, S24 and S25 are carried out for incrementing k from 0 to L, while the step S23 is carried out for deepening the valley of the spectrum. That is, with a spectral envelope as an output signal being $a_{m_e2}[k]$, the second enhancement operation performs an operation $$a_{m_e2}[k]=a_{m_e}[k]+\lim_2(a_m[k]-\mathrm{ave}[k])\cdot w_2[\mathrm{int}(kM/L)] \tag{7}$$

for $0 \leqq k < L$.

In the equation (7), the first term $a_{m_e}[k]$ of the right side stands for a spectral envelope processed with the first emphasis operation, while $a_m[k]$ and ave[k] stand for the spectral envelope not processed with the emphasis processing and the previously found moving average which is herein used unchanged.

In the above equation (7), the function $w_2[\ ]$ is a weighting coefficient of rendering the emphasis processing more effective on the low range side. The number of the length of an array or the number of elements is set to a number (M+1) ranging from $w_2[\mathbf{0}]$~$w_2[M]$. Since k is an index indicating the harmonics number, $k\times\omega_0$ stands for the angular frequency if $\omega_0$ is the basic angular frequency corresponding to the pitch. That is, the value of k itself is not directly coincident with the frequency. Thus, considering that L is changed with $\omega_0$, the value of k is normalized with the maximum value L of k so that the value of k is changed in a range of from 0 to M regardless of the value of L. The meaning of int(kM/L) is that the value of k is now associated with the frequency. M is a fixed number, such as 44, and M+1 inclusive of the dc component is 45. Consequently, $w_2[i]$ is in a 1 to 1 correspondence with respect to the frequency in a range of from $0 \leqq i \leqq M$. The function int( ) returns the closest integer and $w_2[i]$ is changed from 1 towards 0 with increase in i.

Figure 6:
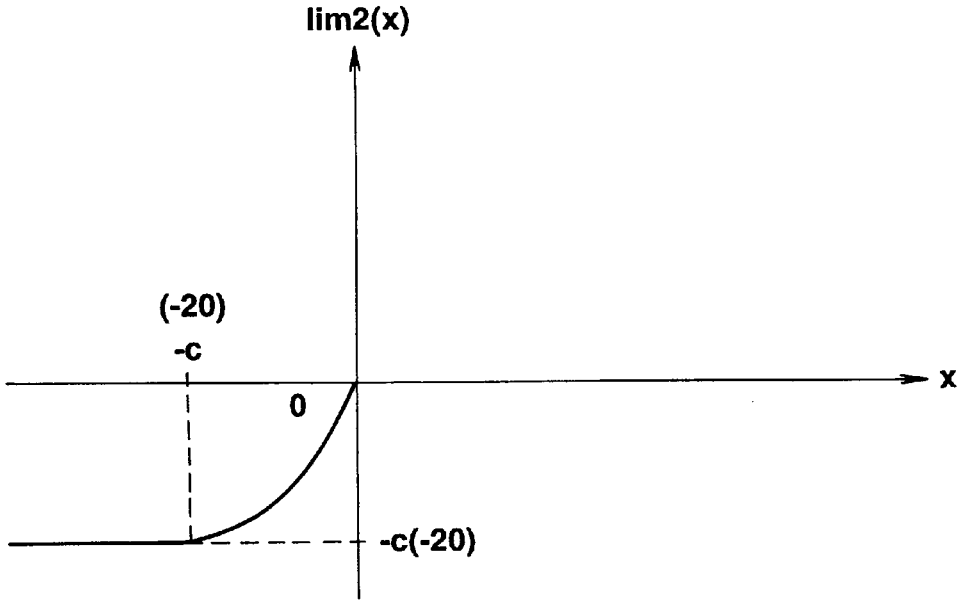
FIG. 6 is a chart showing a function employed in the second emphasis operation.

The function $\lim_2(\ )$ in the above equation (7) outputs $$\lim_2(x)=0:\ \text{for } x \geqq 0$$

$$\lim_2(x)=-c(-x/c)^{1/2}:\ \text{for } 0>x \geqq -c$$

$$\lim_2(x)=-c:\ \text{for } -c>x \tag{8}$$

for an input x. FIG. 6 shows an example in which c=20.

If a given frame is judged at a step S21 in FIG. 5 to be an unvoiced (UV) frame, the program shifts to steps S26 to S29 where an output $a_{m_e2}[k]$ is produced without carrying out emphasis processing on the input $a_{m_e}[k]$. That is, $$a_{m_e}[k]=a_{m_e}[k]$$

is produced for $0 \leqq k \leqq L$. The processing of directly replacing an output by an input is carried out at step S27, while the index value k is incremented from 0 to L for the steps S26, S28 and S29.

The output from the second emphasis step $a_{m_e2}[k]$ is produced in this manner. In the present embodiment, the spectral valley deepening is actually performed only for the voiced (V) frame. Although the value of c is selected to a larger value of, for example, 20, which represents significant deformation, this raises no problem because actual emphasis is carried out for the V-frame. If the emphasis is carried out uniformly without making distinction between the voiced (V) frame and the unvoiced (UV) frame, a foreign, "shari-shari" sound is occasionally produced. Thus it becomes necessary to take measures for reducing the value of c.

By the above-described first and second emphasis operations, the nasalized feeling in the low-pitch speech of a male speaker is significantly eliminated to give the clear speech quality. For producing a more 'modulated' speech quality, the third step S3 of FIG. 1 is carried out by way of the third emphasis processing operation. This operation, which performs formant emphasis of the voiced (V) frame in the signal rising portion, is now explained by referring to a flow chart of FIG. 7.

Figure 7:
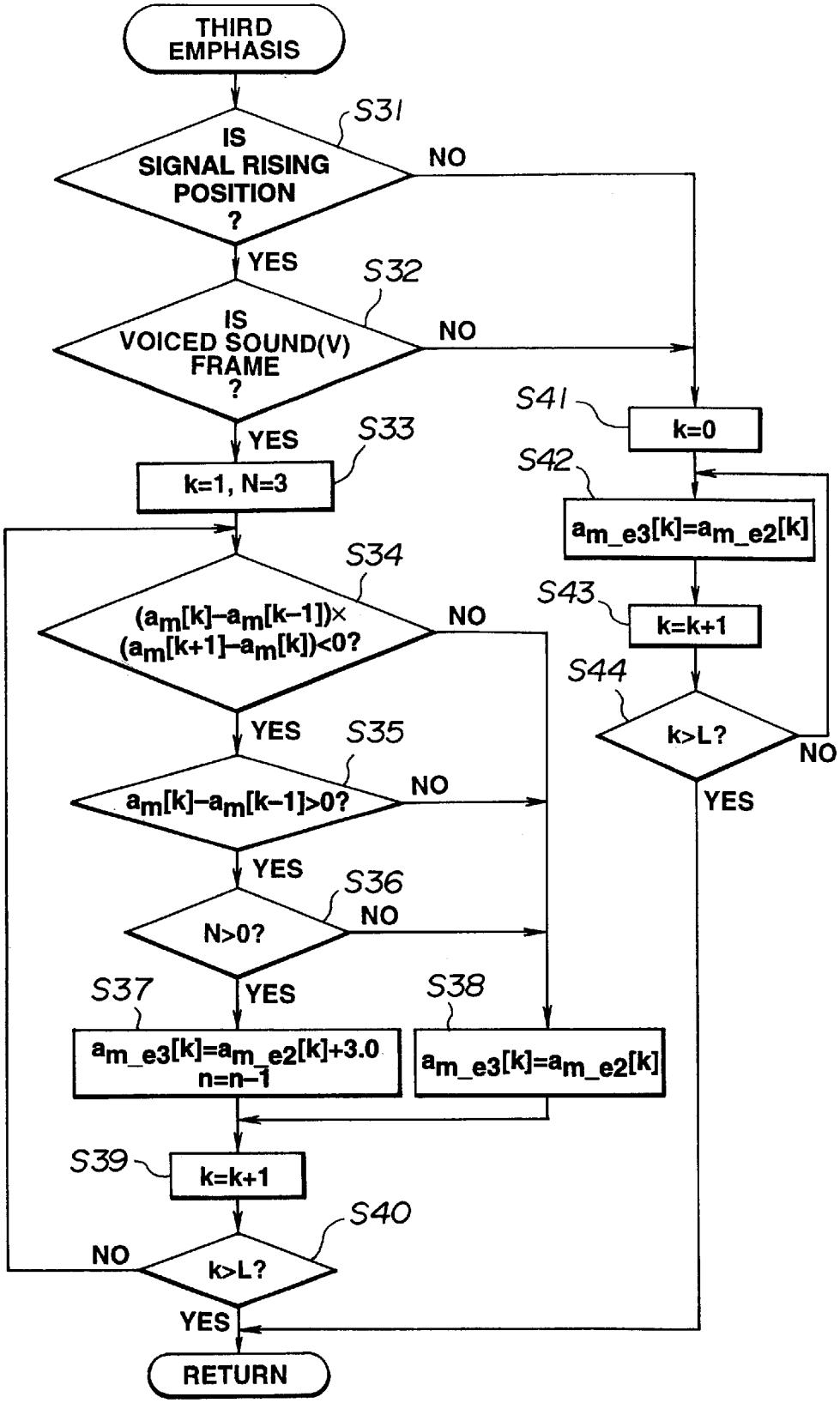
FIG. 7 is a flow chart showing the operation of the third emphasis operation of the processing method.

At first and second steps S31 and S32 of FIG. 7, it is determined whether or not the current signal portion is the signal rising portion and whether or not the current signal portion is a voiced (V) frame, respectively. If the results of the steps S31 and S32 are both YES, the emphasis operations of the steps S33 to S40 are carried out.

The judgment as to whether or not the current signal portion is the signal rising portion, which may be achieved by a number of methods, is given in the present embodiment in the following manner. That is, the signal magnitude of the current frame is defined by the following equation:

$$Sa_{m_c} = \sum_{k=0}^{L} a_m[k] \tag{9}$$

where a value of the log spectral intensity is used for $a_m[k]$. With the signal magnitude of the directly previous frame of $Sa_{m_p}$, if the signal is assumed to be rising for $$Sa_{m_c}/Sa_{m_p} > th_a \tag{10}$$

a changeover point (transient) flag tr is set and tr is set to unity (tr=1). Otherwise, tr=0. A practical illustrative value for the threshold value $th_a$ is $th_a$=1.2. The log value of 1.2 corresponds to a linear value of approximately 2.

In the above equation (9), the values of the log spectral intensity $a_m[k]$ are simply summed for finding the approximate signal value. However, the energy values found in the linear region or rms values may also be employed. Alternatively, an equation $$Sa_{m_c} = \frac{1}{L+1}\sum_{k=0}^{L} a_m[k]$$

may be employed for the equation (9). Also, in place of following the equation (10), the transient flag tr may be set, that is tr may be set to unity (tr=1), in case $Sa_{m_c} - Sa_{m_p > thb}$. A practical example of the threshold value $th_b$ for this case is e.g., 2.0 ($th_b$=2.0).

At step S31 of FIG. 7, it is judged whether or not the transient flag tr is equal to unity. If the result is YES, the program shifts to step S32 and, if otherwise, to step S41. The decision at step S32 as to whether the current frame is the voiced (V) frame may be made in the same manner as at step S21 of FIG. 5. If the above-described emphasis processing has been made previously, the result of V frame decision carried out at the step S21 may be directly employed.

As to the processing operations of the steps S33 to S40, to which the program shifts if the result of decision at step S32 is YES, the practical emphasis processing is carried out at step S37. If, for $0 \leqq k \leqq L$, $a_m[k]$ is a formant peak, the third emphasized output $a_{m_e3}[k]$ is set to $$a_{m_e3}[k] = a_{m_e2}[k] + 3.0 \tag{11}$$

whereas the other values $a_m[k]$ are not processed at step S38 and set so that $$a_{m_e3}[k] = a_{m_e2}[k]$$

where $a_{m_e2}[k]$ stands for an input fed to the third emphasis processing step through the second emphasis processing step.

The formant peak, that is the apex point of a curve in the spectral envelope which becomes upwardly convex, is detected at steps S34 and S35. That is, in a range of from $1 \leqq k \leqq L$, k which will satisfy $$(a_m[k] - a_m[k+1])\ (a_m[k+1] - a_m[k]) < 0 \text{ and}$$

$$(a_m[k] - a_m[k+1]) > 0 \tag{12}$$

represents a peak position. If k is denoted as $k_1, k_2, \ldots k_N$, looking from the low frequency side, $k_1$ represents the first formant, $k_2$ represents the second formant, . . . and $k_N$ represents the N'th formant.

In the present embodiment, detection of the formant peak and the processing of the equation (11) are discontinued when the three points from the low range side have met the condition of the equation (12). This is achieved by setting so that N=3 at the initializing step S33, detecting whether or not N=0 at step S36 following peak detection and by carrying out the decrementing step of N=N−1 simultaneously with the calculation of the equation (12).

The processing for the range of $1 \leqq k \leqq L$ is sequentially performed by the initializing step S33 of k=1, the incrementing step S39 of k=k+1 and the decision step S40 as to whether or not k>L.

If the result of one of the steps S31 and S32 is NO, that is if the current signal portion is not the signal rising portion (tr=0) nor a voiced (V) frame, the processing operation of directly replacing the output $a_{m_e3}[k]$ by an input $a_{m_e2}[k]$ for the range of $0 \leqq k \leqq L$ is carried out by the steps S41 to S44.

By the above-described third emphasis processing operation of raising the formant peak of the voiced (V) frame, the further 'modulated' speech quality may be produced. In addition, by restricting the formant emphasis to the rising portion, the distortion by side effects which will give an impression as if two speakers were talking simultaneously is suppressed.

In the third emphasis processing, only the peak point is increased by 3 dB by the above equation (12). Alternatively, the convex portions only may be emphasized in their entirety. The amount of emphasis also is not limited to 3 dB. In addition, two or less peaks or four or more peaks as counted from the low frequency range side may be emphasized instead of emphasizing three peak points as counted from the low frequency range side.

Figure 8:
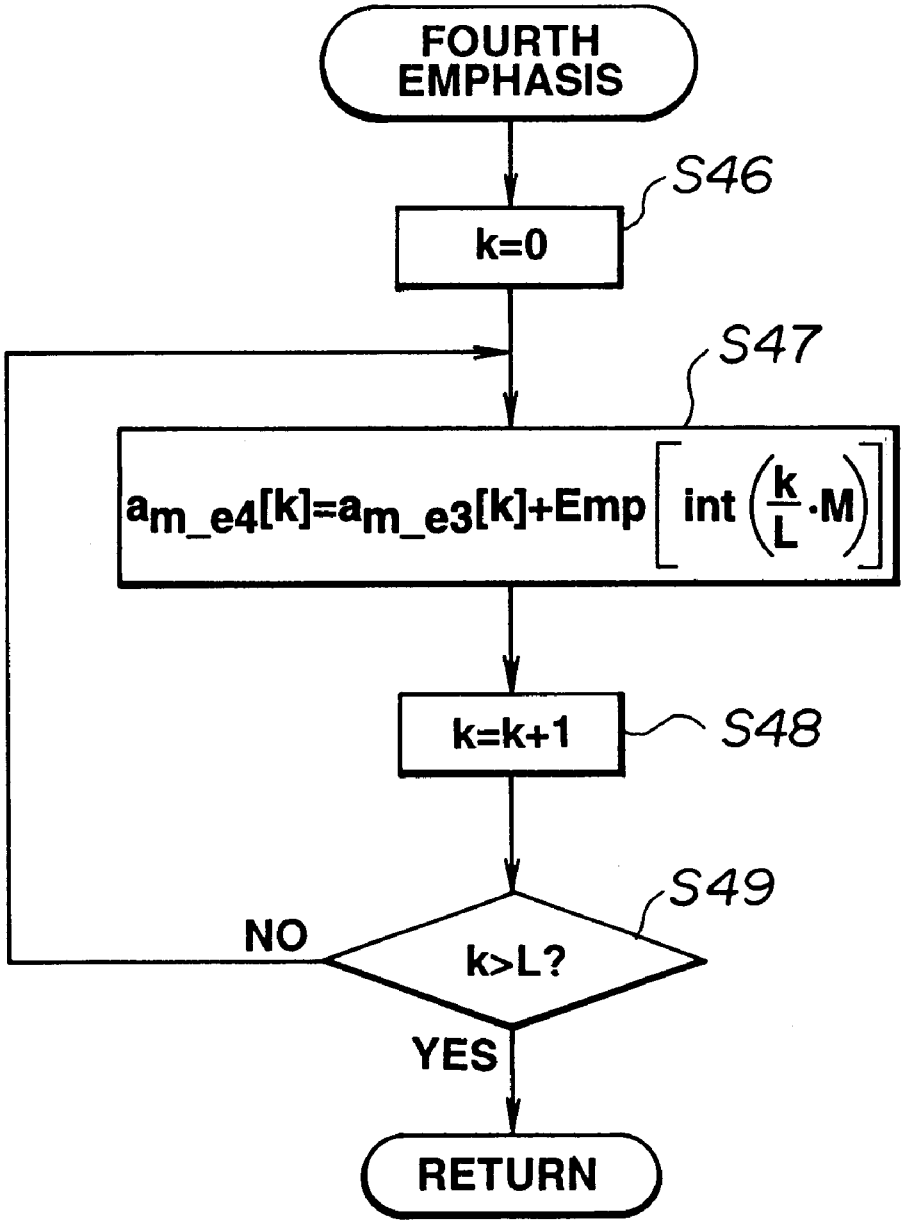
FIG. 8 is a flow chart showing the operation of the fourth emphasis operation of the processing method.

The high range emphasis processing operation as the fourth emphasis processing of the step S4 in FIG. 1 will be explained by referring to the flow chart of FIG. 8.

The fourth emphasis processing operation unconditionally emphasizes the high-range spectrum. That is, an initializing step of k=0 is carried out at step S46 of FIG. 8, and an emphasis processing of $$a_{m_e4}[k]=a_{m_e3}[k]+\mathrm{Emp}[\mathrm{int}(kM/L)] \quad (13)$$

is carried out at the next step S47. The meaning of the resulting int(kM/L) is that k is normalized at the maximum value L of k so that the value of k will be changed in a range of from 0 to M for correlating the value of k with the frequency, as in the case of the above-described equation (7).

An array Emp[i] consists of (M+1) elements of from 0 to M, where M may, for example, be 44.

At step S48, k is incremented and, at the next step S49, it is judged whether or not k>L. If the result is NO, the program returns to step S47 and, if otherwise, the program is returned to main routine.

Figure 9:
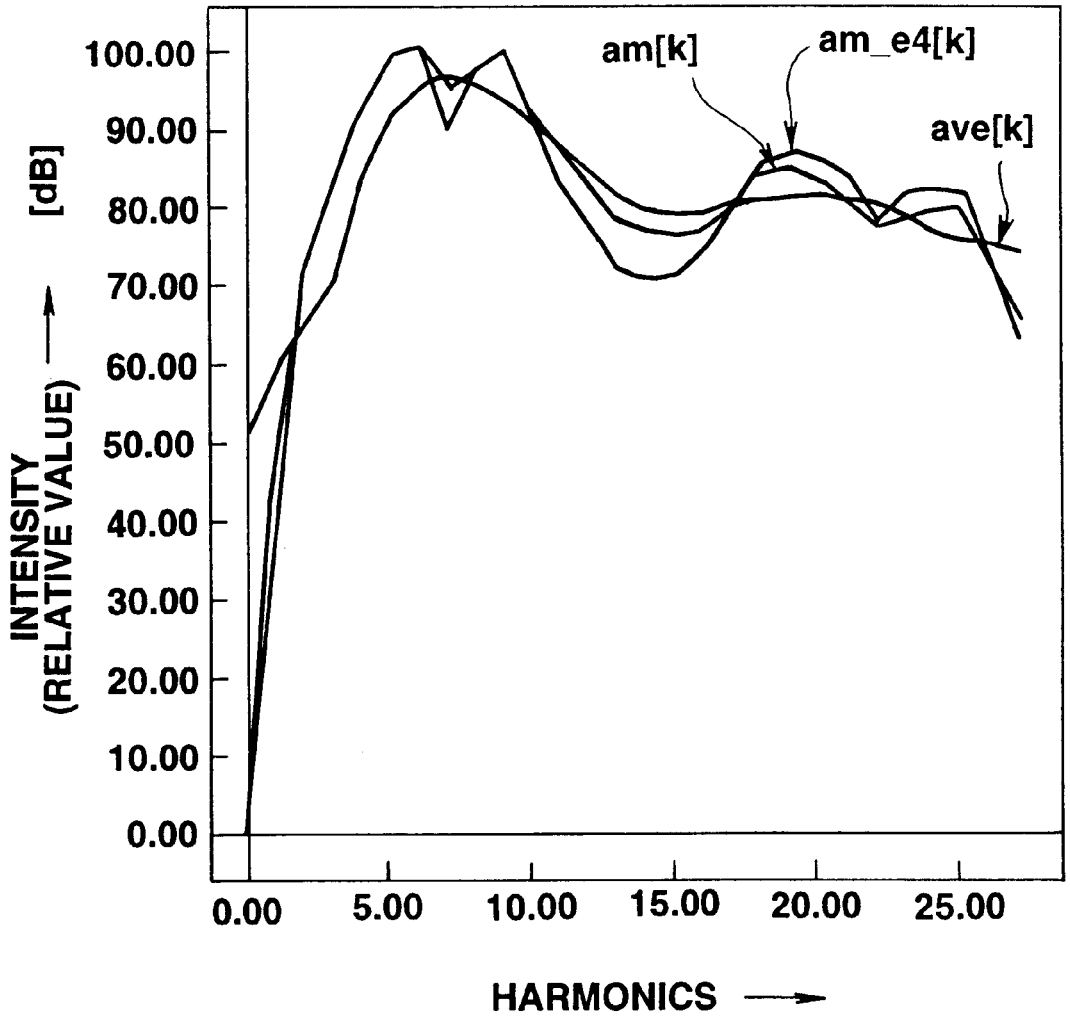
FIG. 9 is a waveform diagram for showing an emphasis operation for a steady-state signal portion.
Figure 10:
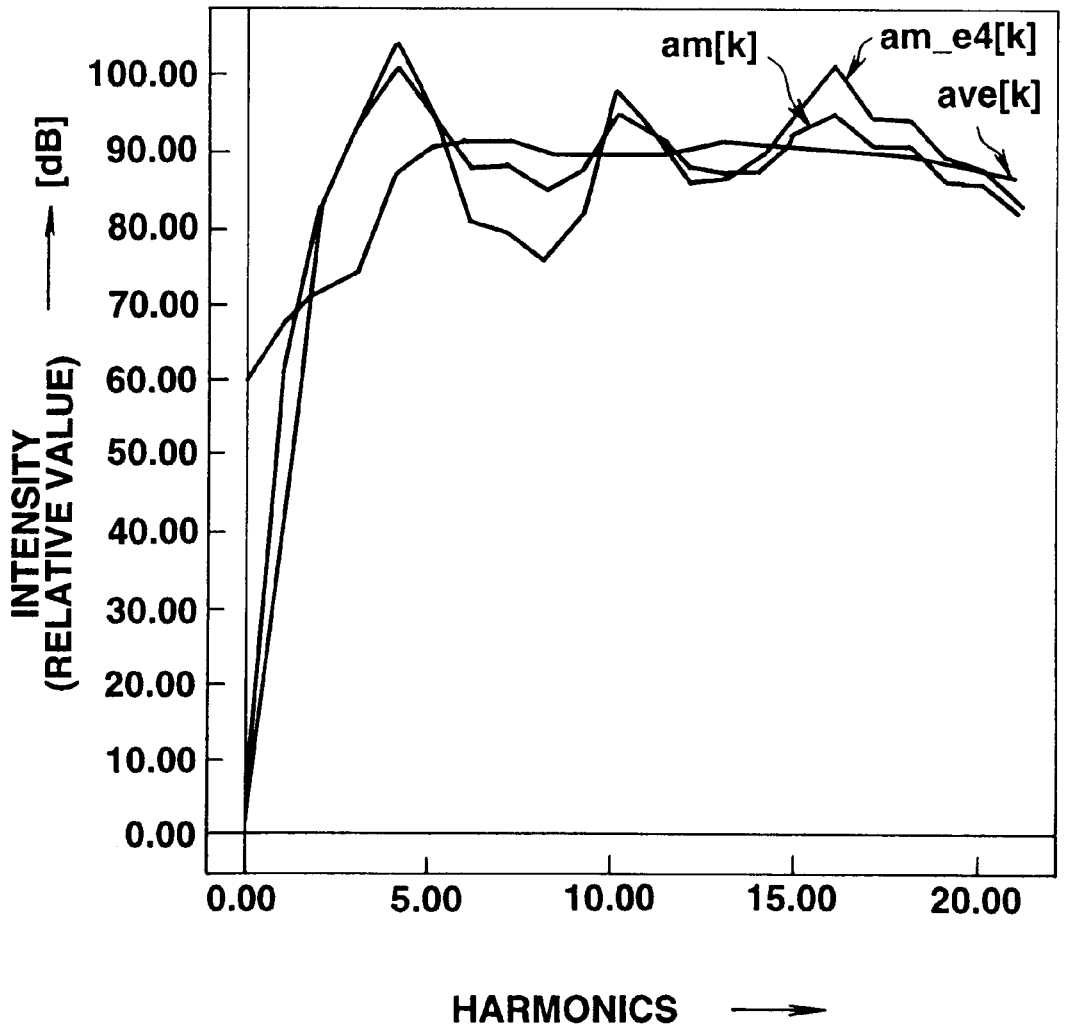
FIG. 10 is a waveform diagram for showing an emphasis operation for a rising signal portion.

In FIGS.9 and 10, there is shown a practical example of the amplitude or intensity of the spectral envelope $a_m[k]$ prior to the first to fourth emphasis processing operations, the moving average ave[k] and the amplitude or intensity values $a_{m_e4}[k]$ produced on executing the first to fourth emphasis operations. Specifically, FIGS.9 and 10 illustrate corresponding curves at the steady-state portion and the rising portion, respectively.

In the example of FIG. 9, formant emphasis processing of the voiced frame at the signal rising portion, which is the above-mentioned third emphasis processing operation, is not performed. In the example of FIG. 10, all processing operations inclusive of the third emphasis processing operations are carried out.

A practical example of a multiband excitation (MBE) vocoder, which falls under the synthesis analysis encoding device for speech signals, is explained as an example of an encoder for supplying signals to a speech synthesis system for carrying out the speech signal processing method according to the present invention. The MBE vocoder is disclosed in "Multiband Excitation Vocoder" by D. W. Griffin and J. S. Lim, IEEE Trans. Acoustics, Speech and Signal Processing, vol. 36, No. 8, pp. 1223–1235, August 1988. While the voiced domain and the unvoiced domain are changed over on the block or frame basis for preparation of the speech model with the conventional partial auto-correlation (PARCOR) vocoder, the speech model is formulated with the MBE vocoder on an assumption that there exist a voiced domain and an unvoiced domain in the frequency domain of the same time point or the same time-axis block.

Figure 11:
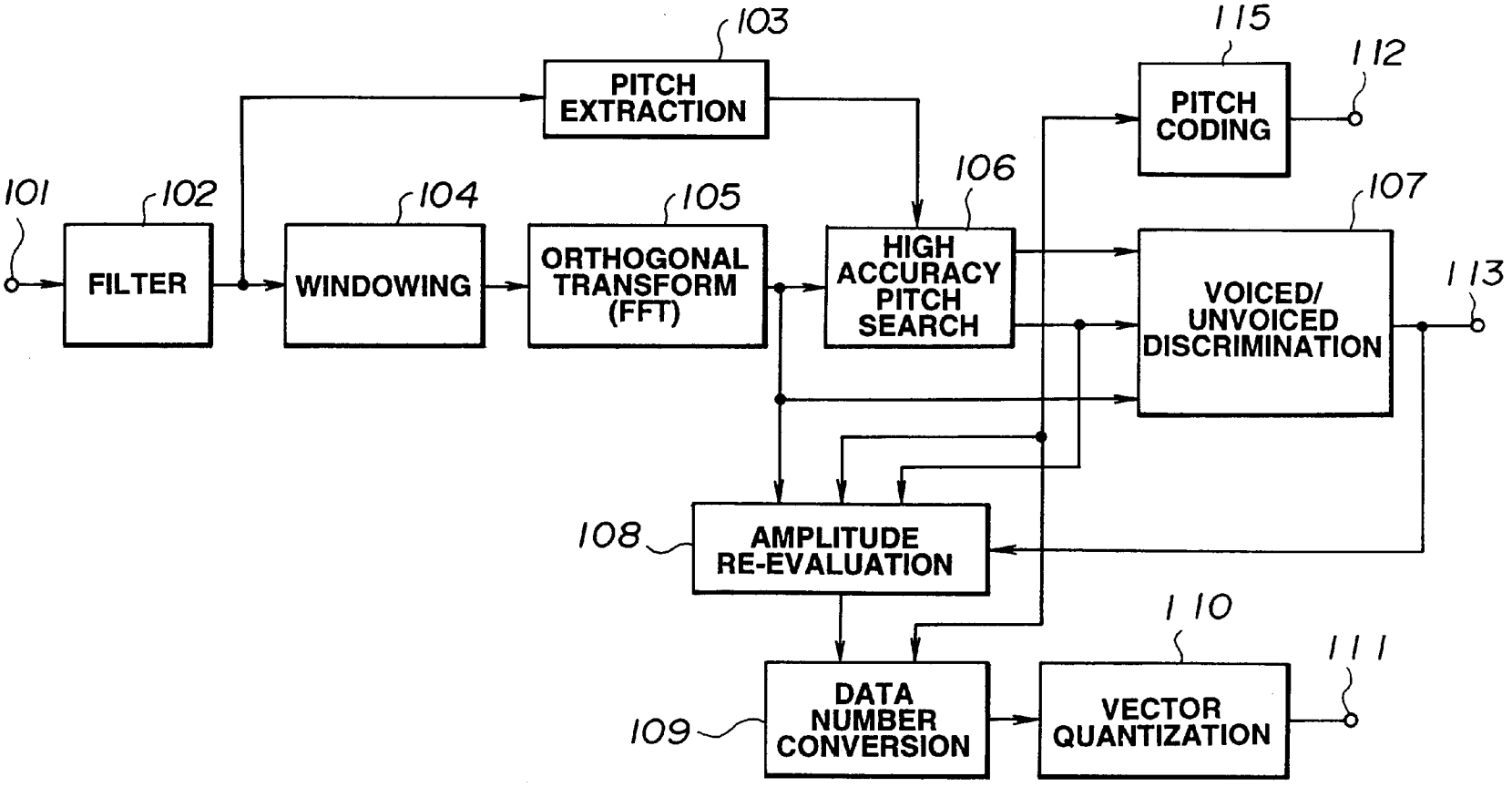
FIG. 11 is a functional block diagram showing a schematic arrangement of an analysis (encoding) side of a speech synthesis analysis device transmitting a signal to a speech decoding device for carrying out the speech signal processing method shown in FIG. 1.

FIG. 11 shows, in a block diagram, a schematic arrangement of the overall MBE vocoder.

In FIG. 11, speech signals are supplied to an input terminal 101 and thence to a high-pass filter 102 so as to be freed of dc offsets and at least low-range components, such as components lower than 200 Hz, by way of bandwidth limitation to e.g., 200 to 3400 Hz. The signal produced via the filter 102 is fed to a pitch extraction unit 103 and to a windowing unit 104. In the pitch extraction unit 103, input signal data is divided into blocks or sliced with a rectangular window, on the basis of a pre-set number of samples N, such as 256 samples, in order to effect pitch extraction of the in-block speech signals. The sliced block, made up of 256 samples, is moved along the time axis at a frame interval of, for example, L samples, such as 160 samples, with an overlap between the blocks being N−L samples, herein 96 samples. In the windowing block 104, each block made up of N samples is multiplied by a pre-set function, such as Hamming function, with the windowed block being sequentially shifted along the time axis at an interval of the frame consisting of L samples. The data string of the windowed output signal is orthogonal-transformed by an orthogonal transform unit 105, such as with fast Fourier transform (FFT).

With the pitch extraction unit 103, the pitch period is determined using, for example, the self-correlation method of the center clip waveform. Specifically, plural peaks are found from self-correlation data belonging to the current frame. The self-correlation is found on the data of the N-sample block. If the maximum peak among these plural peaks is not less than a pre-set threshold, the maximum peak position is adopted as the pitch period. If otherwise, a peak is found which is within a pre-set range satisfying a pre-set relation with respect to the pitch found in the frames other than the current frame, for example, in the forward and backward frames, such as within a range of ±20% with respect to the center of the pitch of the forward frame, and the pitch of the current frame is determined on the basis of the thus found peak position. In the pitch extraction unit 103, rough pitch search is carried out on the open loop basis. The extracted pitch data is transmitted to a fine pitch search unit 106 where high precision pitch search is carried out on the closed loop basis.

The high precision pitch search unit 106 is fed with rough pitch data of integer values extracted by the pitch extraction unit 103 and with data on the frequency axis processed with FFT by the orthogonal transform unit 105. The high-precision pitch search unit 106 swings the data at an interval of 0.2 to 0.5 by ± several samples, about the rough pitch data values as the center, for driving the pitch data to fine pitch data in the floating point notation. The fine pitch search technique employs the so-called analysis by synthesis method, and the pitch is selected so that the synthesized power spectrum will be closest to the power spectrum of the original sound.

The optimum pitch and amplitude $|A_m|$ from the high precision pitch search unit 106 are transmitted to a voiced/unvoiced discrimination unit 107 where the voiced/unvoiced discrimination is carried out from band to band. The noise to signal ratio (NSR) is utilized for the discrimination. That is, if the NSR value is larger than the pre-set threshold, such as 0.3, that is if the error amount is considerable, the subject band is judged to be unvoiced. If otherwise, it may be inferred that approximation has been carried out satisfactorily to some extent, so that the subject band is judged to be voiced.

The frequency-domain data from the orthogonal transform unit 105, the amplitude $|A_m|$ evaluated to be of the fine pitch from the high-precision pitch search unit 106 and the voiced/unvoiced (V/UV) discrimination data from the voiced/unvoiced discrimination unit 107 are fed to an amplitude re-evaluation unit 108. The amplitude re-evaluation unit 108 again finds the amplitude $|A_m|_{UV}$ with respect to the band found to be unvoiced (UV) in the voiced/ unvoiced discrimination unit 107.

Output data of the amplitude re-evaluation unit 108 is transmitted to a data number conversion unit 109 which is a sort of the sampling rate conversion unit. The data number conversion unit 109 provides a constant number of data, especially the amplitude data, in consideration that the number of bands on the frequency axis is varied depending on the pitch and hence the number of data and especially the amplitude data are varied. That is, if the effective bandwidth is up to 3400 Hz, this effective bandwidth is divided into 8 to 63 bands, depending on the pitch, while the number of data of the amplitude $|A_m|$, inclusive of the amplitude $|A_m|_{UV}$, produced from band to band, is also changed in a range of from 8 to 63. Thus the data number conversion unit 109 converts the variable number of the amplitude data into a constant number $N_c$, such as 44.

In the present embodiment, dummy data which will interpolate values of data from the last data up to the first data in a block is added to one-block of amplitude data on the frequency axis for enlarging the number of data to $N_F$. The resulting data is processed with bandwidth limiting type $K_{OS}$-fold, such as eight-fold over-sampling, to find a $K_{OS}$-fold number of amplitude data. The $K_{OS}$-fold number of amplitude data ($(m_{MX}+1)\times K_{OS}$ data) is processed with linear interpolation for enhancing the data number to a larger number ($N_k$), such as 2048. This $N_M$ number of data are sub-sampled for conversion into the above-mentioned constant number $N_c$, such as 44.

Output data of the data number conversion unit 109, that is the constant number $N_C$ of the amplitude data, is transmitted to a vector quantization unit 110 where it is grouped into sets each made up of a pre-set number of data vectors which are processed with vector quantization. Output quantized data of the vector quantization unit 110 is outputted to an output terminal 111. Fine-pitch data from the high precision pitch search unit 106 is encoded by a pitch encoding unit 115 so as to be outputted at an output terminal 112. Voiced/unvoiced (V/UV) discrimination data from the voiced/unvoiced discrimination unit 107 is outputted at an output terminal 113. The data outputted at the output terminals 111 to 113 are transmitted as signals of a pre-set format.

The above data are produced on processing the in-block data consisting of the N samples, such as 256 samples. Since the blocks are advanced on the time axis with the L-sample frame as the unit, the transmitted data is produced on the frame unit. That is, the pitch data, the V/UV discrimination data and the amplitude data are updated on the frame period.

Although the encoder configuration shown in FIG. 11 and the decoder configuration shown in FIG. 2 are shown as embodied in hardware, they may also be implemented by a software program using a digital signal processor (DSP).

The present invention is not limited to the above-described embodiments. For example, the operating sequence of the first to fourth emphasis operations may be interchanged, while one or more of the processing operations may be omitted. In addition, the speech synthesis device for carrying out the speech signal processing method of the present invention is not limited to the embodiment of FIG. 2. For example, the emphasis processing may also be performed on signals prior to data number conversion. In addition, emphasis processing may also be performed without performing data number conversion on the encoder side or inverse data number conversion on the decoder side.

What is claimed is:

1. A speech signal processing method for decoding a speech signal encoded by a speech encoding method in which a speed signal is represented by parameters in at least a frequency domain, comprising the steps of:

smoothing on the frequency axis a signal representing an intensity of the frequency spectrum;

comparing a signal representing an intensity of the frequency spectrum with the smoothed version of the signal obtained in the smoothing step;

taking the difference between the signal representing the intensity of the spectrum and the version of said signal obtained on smoothing on the frequency axis;

performing a processing of deepening valley portions between formants of a transmitted frequency spectrum using the results of the comparing step;

wherein said step of processing of deepening the valley portions between the formants of the frequency spectrum is performed using the result of the step of taking the difference between the signal representing the intensity of the spectrum and the version of said signal obtained on smoothing on the frequency axis.

2. The speech signal processing method as claimed in claim 1 wherein an amount of attenuation of deepening of said valley portions between the formants of the frequency spectrum is varied depending on the magnitude of said difference.

3. The speech signal processing method as claimed in claim 1 comprising the further steps of:

discriminating whether the signal indicating the intensity of the transmitted frequency spectrum is of a voiced domain or an unvoiced domain and performing said processing only when the signal is of the voiced domain.

4. A speech signal processing method employed in a speech synthesis system centered about processing in the frequency domain, comprising the steps of:

dividing the speech signal into a plurality of frames;

calculating an energy of the speech signal for each of the frames sequentially;

comparing the calculated energy of the current frame with the calculated energy of the previous frame in order to detect a transient portion where speech energy rapidly increases in the time domain; and emphasizing formant peaks of the frequency spectrum in the detected transient portion by directly acting on frequency domain parameters when the transient portion is detected in the comparing step.

5. The speech signal processing method as claimed in claim 4, further comprising the steps of:

discriminating whether the speech signal is of a voiced domain or an unvoiced domain; and carrying out said emphasizing of the formant peak only for a voiced domain.

6. The speech signal processing method as claimed in claim 4 wherein said emphasizing is carried out only on a low-range side of the frequency spectrum.

7. A speech signal processing method for decoding a speech signal encoded by a speech encoding method in which a speech signal is represented by parameters in at least a frequency domain, comprising the steps of:

smoothing on the frequency axis a signal representing an intensity of the frequency spectrum;

comparing a signal representing an intensity of the frequency spectrum and the smoothed version of the signal obtained in the smoothing step; and performing a processing of deepening valley portion between format of a transmitted frequency spectrum using the result of the comparing steps, wherein said smoothing step is carried out by taking moving averages obtained by averaging spectrum intensity values in predetermined frequency windows successively defined in frequency domain.

* * * * *